US010270182B2

(12) United States Patent
Jang et al.

(10) Patent No.: US 10,270,182 B2
(45) Date of Patent: Apr. 23, 2019

(54) METAMATERIAL-BASED ELECTROMAGNETIC WAVE POLARIZATION CONVERTER

(71) Applicant: GWANGJU INSTITUTE OF SCIENCE AND TECHNOLOGY, Gwangju (KR)

(72) Inventors: Jae Hyung Jang, Gwangju (KR); Jeong min Woo, Gwangju (KR)

(73) Assignee: GWANGJU INSTITUTE OF SCIENCE AND TECHNOLOGY, Gwangju (KR)

( * ) Notice: Subject to any disclaimer, the term of this patent is extended or adjusted under 35 U.S.C. 154(b) by 148 days.

(21) Appl. No.: 15/400,280

(22) Filed: Jan. 6, 2017

(65) Prior Publication Data

US 2017/0201030 A1 Jul. 13, 2017

(30) Foreign Application Priority Data

Jan. 8, 2016 (KR) ..... 10-2016-0002589

(51) Int. Cl.
*H01Q 15/00* (2006.01)
*H01Q 9/04* (2006.01)
*H01Q 13/10* (2006.01)

(52) U.S. Cl.
CPC ..... *H01Q 15/0086* (2013.01); *H01Q 9/0485* (2013.01); *H01Q 13/106* (2013.01)

(58) Field of Classification Search
CPC . H01Q 15/0086; H01Q 9/0485; H01Q 13/106
See application file for complete search history.

(56) References Cited

U.S. PATENT DOCUMENTS

2015/0303584 A1* 10/2015 Liu ..... H01Q 15/0086 343/753

FOREIGN PATENT DOCUMENTS

CN 102738594 A 10/2012

OTHER PUBLICATIONS

Japanese Office Action dated Mar. 6, 2018 for corresponding Japanese Application No. 2017-001690.

* cited by examiner

*Primary Examiner* — Jessica Han
*Assistant Examiner* — Jae K Kim
(74) *Attorney, Agent, or Firm* — Hauptman Ham, LLP

(57) ABSTRACT

Provided is a metamaterial-based polarization converter in which a reception antenna and a transmission antenna are formed by using a metamaterial, to thus emit an incident non-polarized or polarized electromagnetic wave in an angle-converted polarization direction. The metamaterial-based electromagnetic wave polarization converter includes: a reception antenna made of a metamaterial and allowing incident electromagnetic waves to resonate at a surface of the reception antenna to generate a surface current; a transmission antenna at a rear side of the reception antenna, and made of an angle-converted metamaterial to thus allow the electromagnetic waves transferred from the reception antenna to resonate to then be emitted in a polarization direction; and a connector made of a conductive material that connects the reception antenna and the transmission antenna, to thereby transfer a surface current generated from the reception antenna to the transmission antenna.

7 Claims, 10 Drawing Sheets

METAMATERIAL-BASED ELECTROMAGNETIC WAVE POLARIZATION CONVERTER

CROSS-REFERENCE TO RELATED APPLICATION

This application claims the benefit of Korean Patent Application No. 10-2016-0002589, filed on Jan. 8, 2016, in the Korean Intellectual Property Office, the disclosure of which is incorporated herein in its entirety by reference.

BACKGROUND OF THE INVENTION

1. Field of the Invention

The present invention relates to a metamaterial-based electromagnetic wave polarization converter, and more particularly, to a metamaterial-based electromagnetic wave polarization converter in which a reception antenna and a transmission antenna are formed by using a metamaterial, to thus emit an incident non-polarized or polarized electromagnetic wave in an angle-converted polarization direction.

2. Description of the Related Art

Many radio frequency antenna units mainly produce linearly polarized electromagnetic radiation. When a device such as a reception antenna is positioned to receive linearly polarized electromagnetic radiation, the directionality of the reception antenna associated with the transmitted electromagnetic radiation is important to receive a strong signal.

Most polarization converters used so far are in the form of waveguides or gratings. In recent papers, most polarization converters are configured to include helix structure, metasurface and background plane composites, or bilayer symmetry pattern structures.

Recently, as research on metamaterials has progressed, areas of applications have been expanding. Metamaterials are materials that do not exist in the natural world, and are commonly called artificially designed materials whose electromagnetic characteristics are determined by a material structure.

The materials of nature are composed of atoms or molecules, but the metamaterials consists of an artificial meta-atom structure of a unit having a size smaller than wavelengths of electromagnetic waves incident from the outside. Recently, these metamaterials have attracted the attention of researchers worldwide in that they can artificially control the physical properties of materials for electromagnetic waves and light waves. One of the typical well-known properties among various metamaterials is a negative permeability characteristic, which can be applied to various fields such as negative refractive index, flat plate lens, and electromagnetic wave absorption.

It is believed that large efficiency can be obtained when metamaterials are applied to a device for converting polarized light of an electromagnetic wave in view of characteristics of the metamaterials. However, conventional metamaterial-based electromagnetic wave polarization converter that can readily use in market is need.

SUMMARY OF THE INVENTION

To solve the above problems, it is an object of the present invention to provide a metamaterial-based electromagnetic wave polarization converter that can efficiently emit a non-polarized or polarized electromagnetic wave in a polarization direction whose angle is converted into a desired angle.

According to an aspect of the present invention, there is provided a metamaterial-based electromagnetic wave polarization converter comprising: a reception antenna made of a metamaterial and allowing incident electromagnetic waves to resonate at a surface of the reception antenna to generate a surface current; a transmission antenna at a rear side of the reception antenna, and made of an angle-converted metamaterial to thus allow the electromagnetic waves transferred from the reception antenna to resonate to then be emitted in a polarization direction; and a connector made of a conductive material that connects the reception antenna and the transmission antenna, to thereby transfer a surface current generated from the reception antenna to the transmission antenna.

Preferably but not necessarily, the reception antenna includes a first panel member of a plane shape and a first slot formed on the first panel member and extending in one direction of the first panel member, the first slot being made of the metamaterial, and the transmission antenna includes a second panel member of a plane shape and a second slot formed on the second panel member and extending in a direction intersecting with the first slot of the first panel member, the second slot being made of the angle-converted metamaterial, in which the second slot is preferably extended to form a predetermined angle with respect to the first slot to correspond to a conversion angle of an electromagnetic wave to be converted.

Preferably, the connector includes a surface layer made of gold, and holes respectively corresponding to the connector are formed in the reception antenna and the transmission antenna, at connecting positions where the connector is connected to the reception antenna and the transmission antenna.

It is preferable that a filler material is filled between the reception antenna and the transmission antenna, and the filler material is a cycloolefin polymer.

It is preferable that a separation distance between the reception antenna and the transmission antenna is in a vicinity area.

BRIEF DESCRIPTION OF THE DRAWINGS

Exemplary embodiments of the inventive concept will be more clearly understood from the following detailed description taken in conjunction with the accompanying drawings in which.

DETAILED DESCRIPTION OF THE EMBODIMENTS

Figure 1:
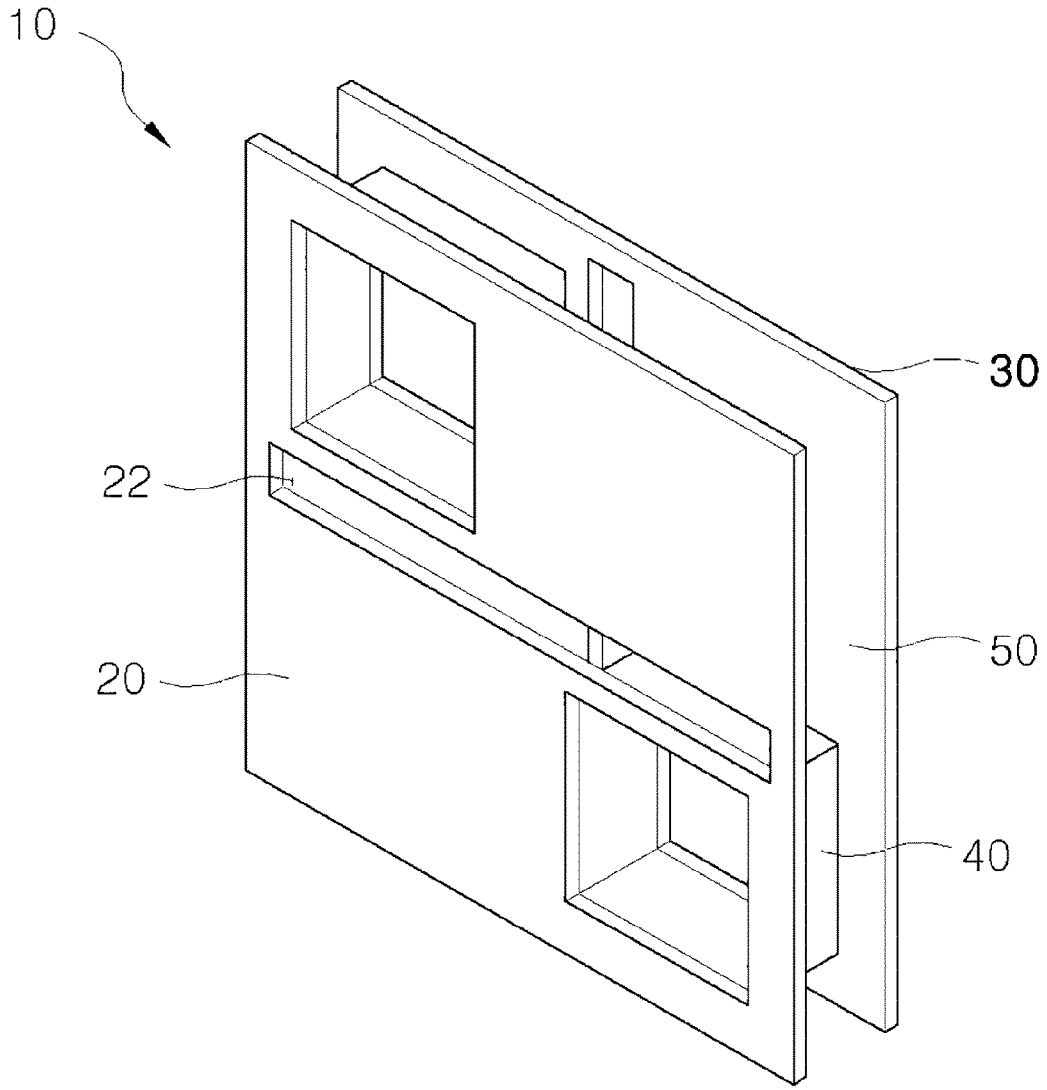
FIG. 1 is a perspective view showing an embodiment of a metamaterial-based electromagnetic wave polarization converter according to an embodiment of the present invention.
Figure 2:
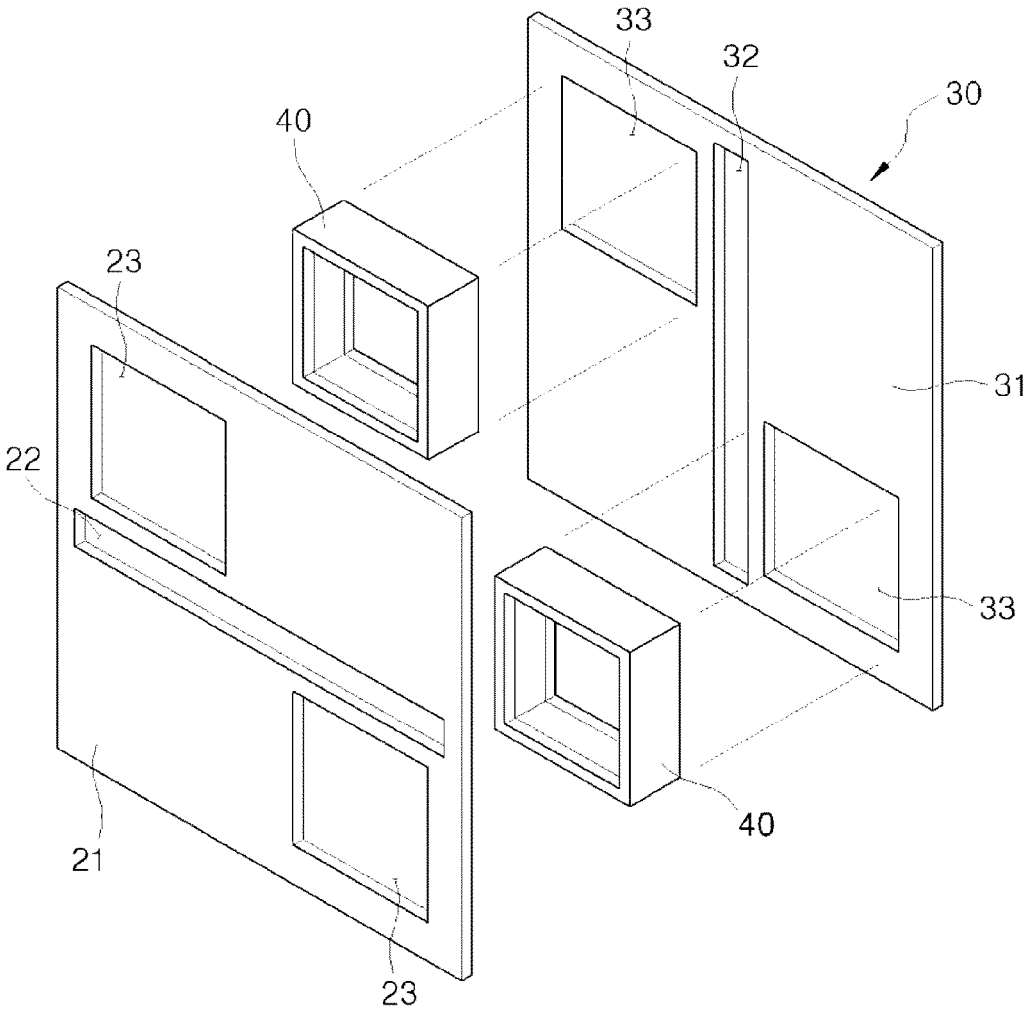
FIG. 2 is an exploded perspective view of the metamaterial-based electromagnetic wave polarization converter of FIG. 1.

Hereinafter, a metamaterial-based electromagnetic wave polarization converter according to an embodiment of the present invention will be described in detail with reference to the accompanying drawings. The present invention is capable of various modifications and various forms, and specific embodiments are illustrated in the drawings and described in detail in the text. It should be understood, however, that the invention is not intended to be limited to the particular forms disclosed, but on the contrary, is intended to cover all modifications, equivalents, and alternatives falling within the spirit and scope of the invention. Like reference numerals are used for similar elements in describing each drawing. In the accompanying drawings, the dimensions of the structures are enlarged to illustrate the present invention in order to clarify the present invention.

The terms first, second, etc. may be used to describe various elements, but the elements should not be limited by the terms. The terms are used only for the purpose of distinguishing one component from another. For example, without departing from the scope of the present invention, the first component may be referred to as a second component, and similarly, the second component may also be referred to as a first component.

The terminology used herein is for the purpose of describing particular embodiments only and is not intended to be limiting of the invention. The singular forms "a," "an," and "the" include plural referents unless the context clearly dictates otherwise. In the present application, the terms "comprise", "having", and the like are used to specify that a feature, a number, a step, an operation, an element, a part, or a combination thereof, but do not preclude the presence or addition of one or more other features, integers, steps, operations, elements, parts, or combinations thereof.

Unless otherwise defined, all terms used herein, including technical or scientific terms, have the same meaning as commonly understood by one of ordinary skill in the art to which this invention belongs. Terms such as those defined in commonly used dictionaries should be interpreted as having a meaning consistent with the meaning in the context of the relevant art and not be construed as ideal or overly formal in meaning unless expressly defined in the present application.

FIGS. 1 to 4 show a metamaterial-based electromagnetic wave polarization converter 10 according to an embodiment of the present invention.

Referring to FIG. 1, the metamaterial-based electromagnetic wave polarization converter 10 includes a reception antenna 20, a transmission antenna 30, connectors 40, and a filler material 50 that is filled between the reception antenna 20 and the transmission antenna 30.

In this case, a metamaterial is made of a conductive material and has a shape of a periodic pattern with a size smaller than a wavelength of an incident electromagnetic wave. The metamaterial is a type of an antenna having a negative permeability, and can control the characteristic of the electromagnetic wave artificially.

The reception antenna 20 includes a first panel member 21 in the form of a square panel and a first slot 22 formed in the first panel member 21.

The first slot 22 is formed so as to extend in a left-right direction at a center portion of the first panel member 21, and is made of a metamaterial.

Two holes 23 are formed in the first panel member 21, and the holes 23 are diagonally spaced at a left upper portion of the first panel member 21 and a right lower portion thereof when viewed from the front thereof.

The transmission antenna 30 is formed at a rear side of the reception antenna 20.

The transmission antenna 30 includes a second panel member 31 corresponding to the first panel member 21 and a second slot 32 formed in the second panel member 31.

The second slot 32 is also formed of a metamaterial, and the direction of the second slot 32 is a direction intersecting with the first slot 22. That is, the first slot 22 extends along the left-right direction at the center portion of the first panel member 21, while the second slot 32 extends vertically at the center portion of the second panel member 31. Since the second slot 32 extends in a direction intersecting with the first slot 22 by a predetermined angle, an incident electromagnetic wave is transmitted in an angle-converted state by the transmission antenna 30.

Two holes 33 are also formed in the second panel member 31 of the reception antenna 20 at the same positions as those formed in the first panel member 21 of the reception antenna 20 so as to be diagonally spaced from each other.

The connectors 40 connect the reception antenna 20 and the transmission antenna 30 to each other.

The connectors 40 are formed so that both ends of the first panel member 21 and the second panel member 31 are connected to each other at the portions where the holes 23 and 33 are formed. The connectors 40 are formed as tubular bodies of shapes and sizes corresponding to the holes 23 and 33, in which a surface layer made of gold (Au) is formed on a surface of each of the connectors 40.

Therefore, when electromagnetic waves are received at the reception antenna 20, resonance occurs on the surface of the metamaterial of the first slot 22, and thus a surface current is generated by resonance.

The generated surface current flows to the transmission antenna 30 along the surface layer of the connectors 40 and resonates at the surface of the metamaterial of the second slot 32 of the transmission antenna 30.

Figure 3:
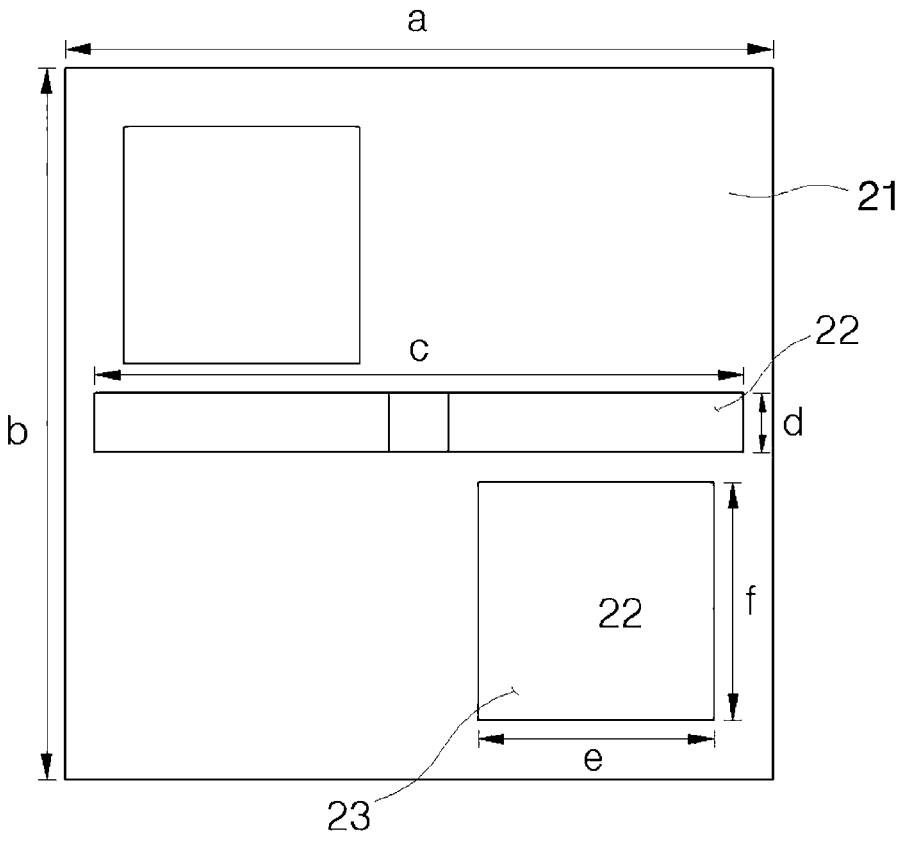
FIG. 3 is a front view of the metamaterial-based electromagnetic wave polarization converter of FIG. 1.

FIG. 3 is a front view of the first panel member 21. Referring to FIG. 3, since the first panel member 21 is formed in the shape of a square panel, the width "a" and the length "b" are identical to each other, and both the width "a" and the length "b" are in this embodiment are 134 μm.

In this embodiment, a resonance frequency is 1 THz, and size of the first slot 22 varies in accordance with magnitude of the resonance frequency.

That is, the left-right length "c" and the width "d" of the first slot 22 are determined by equations $$\frac{\lambda}{[2(\varepsilon_{sub})^2]} \text{ and } \frac{\lambda}{[20(\varepsilon_{sub})^2]},$$

respectively. When the resonance frequency is 1 THz as in the present embodiment, the left-right length "c" of the first slot 22 is 117 μm, and the width "d" of the first slot 22 is 15 μm. In this case, λ is a wavelength of an incident electromagnetic wave, and $\varepsilon_{sub}$ is a dielectric constant of a filler material located between the reception antenna and the transmission antenna. Hereinafter, the same symbols represent the same conceptual meanings.

The width "e" and the length "f" of each of the holes 23 can be obtained by the following equations $$\frac{\lambda}{[2(\varepsilon_{sub})^2]} \text{ and } \frac{3\lambda}{[4(\varepsilon_{sub})^2]},$$

respectively. In this embodiment, the width "e" and the length "f" of each of the holes 23 are formed in a square of 39 μm×39 μm.

The second panel member 31 is formed in the same size as the first panel member 21 and the former differs from the latter only in a point that the second slot 32 is formed to extend vertically.

Figure 4:
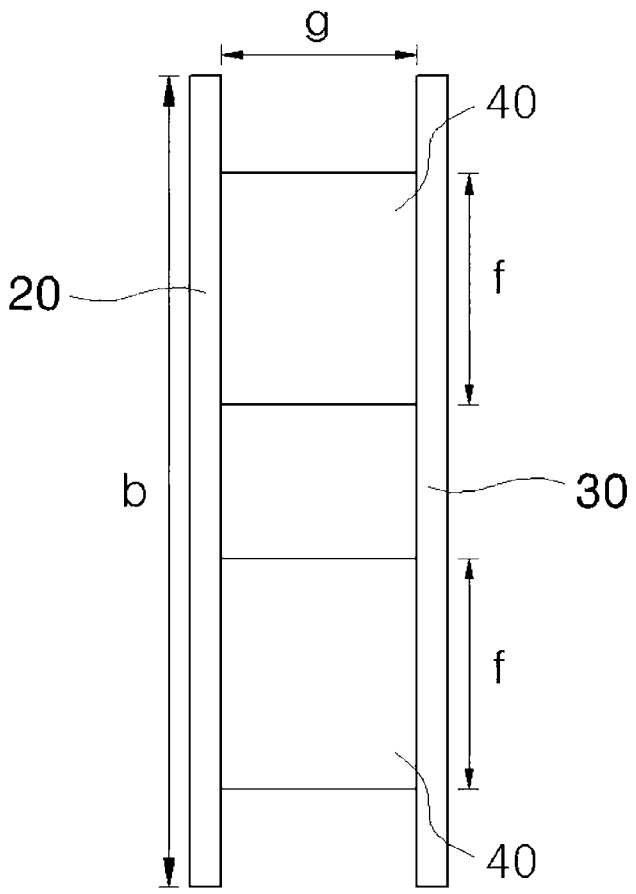
FIG. 4 is a side view of the metamaterial-based electromagnetic wave polarization converter of FIG. 1.

As shown in FIG. 4, a separation distance "g" between the reception antenna 20 and the transmission antenna 30 is 16 μm.

Since polarization conversion efficiency varies depending on the separation distance between the reception antenna 20 and the transmission antenna 30, the separation distance between the reception antenna 20 and the transmission antenna 30 is important.

Figure 5:
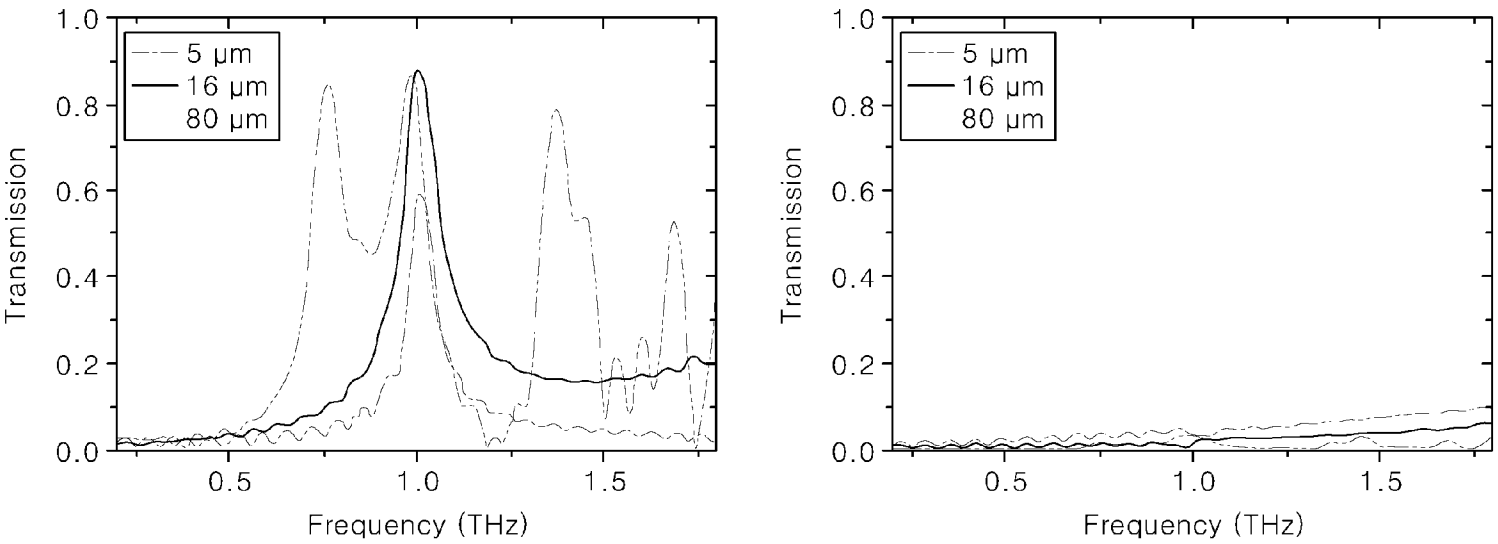
FIGS. 5 to 7 are graphs showing polarization conversion ratio measurement results according to a separation distance between a reception antenna and a transmission antenna in a metamaterial-based electromagnetic wave polarization converter according to an embodiment of the present invention.
Figure 6:
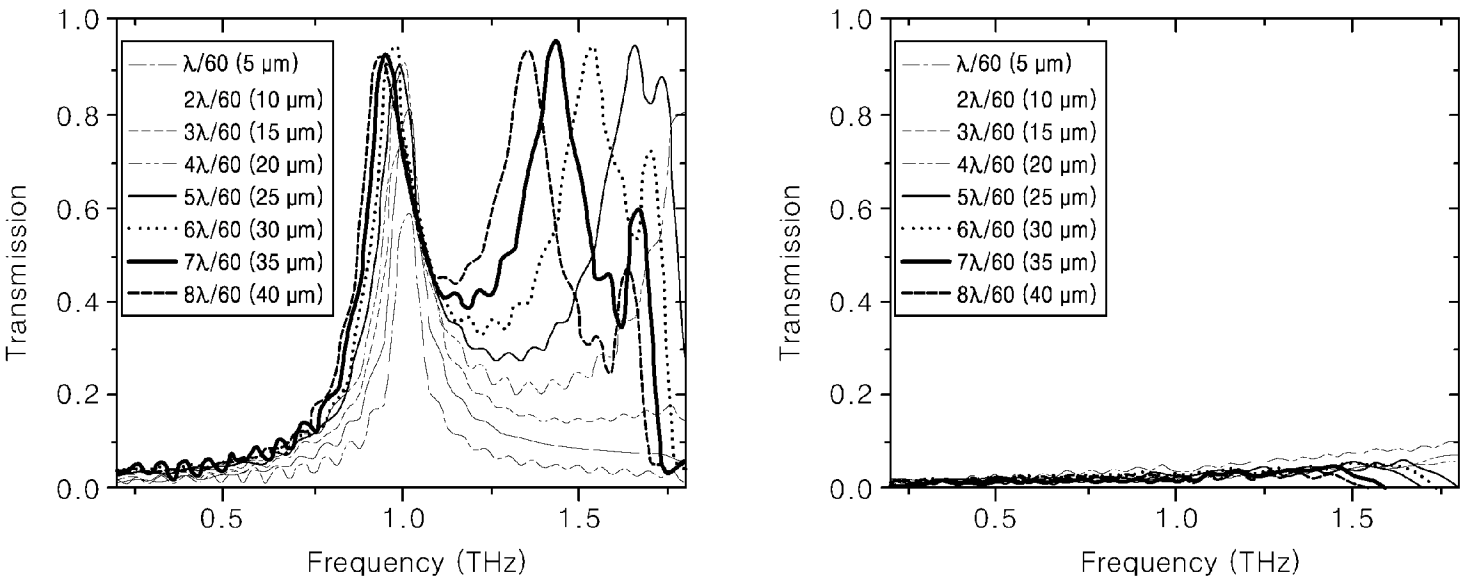

FIGS. 5 and 6 are graphs of experimental results for examining the conversion efficiency of the electromagnetic wave according to the separation distance between the reception antenna 20 and the transmission antenna 30.

The proper separation distance between the reception antenna and the transmission antenna should be within a neighboring area $2L_{slot}^2/\lambda$, and $L_{slot}$ is defined as $\lambda/[2(\varepsilon_{sub})^2]$. When the separation distance "g" is 5 μm ($2L_{slot}^2/\lambda$), the polarization conversion efficiency sharply drops. When the separation distance is 80 μm ($2L_{slot}^2/\lambda$), the polarization conversion efficiency gradually decreases, in comparison with the 16 μm, but the Q-factor decreased and undesired peaks were observed in the inside of the converter due to fabry-perot resonance and the like.

As shown in FIG. 5, only the cases where the separation distances are 5 μm, 16 μm, and 80 μm are separately extracted, the first curve (e.g. solid line) indicates the case where the separation distance between the reception antenna 20 and the transmission antenna 30 is 16 μm, the second curve (e.g. alternated long and short dash line) indicates the case where the separation distance is 5 μm, and the third curve (e.g. alternated long and two short dashes line) indicates the case where the separation distance is 80 μm. When the separation distance "g" is 5 μm, the polarization conversion efficiency sharply drops. When the separation distance is 80 μm, the polarization conversion efficiency gradually decreases, in comparison with the 16 μm, but the Q-factor decreased and undesired peaks were observed in the inside of the converter due to fabry-perot resonance and the like.

When the resonance frequency is 1 THz and the wavelength λ of the electromagnetic wave is 300 μm as in the present embodiment, the appropriate separation distance between the reception antenna 20 and the transmission antenna 30 is 5 μm to 80 μm.

Figure 7:
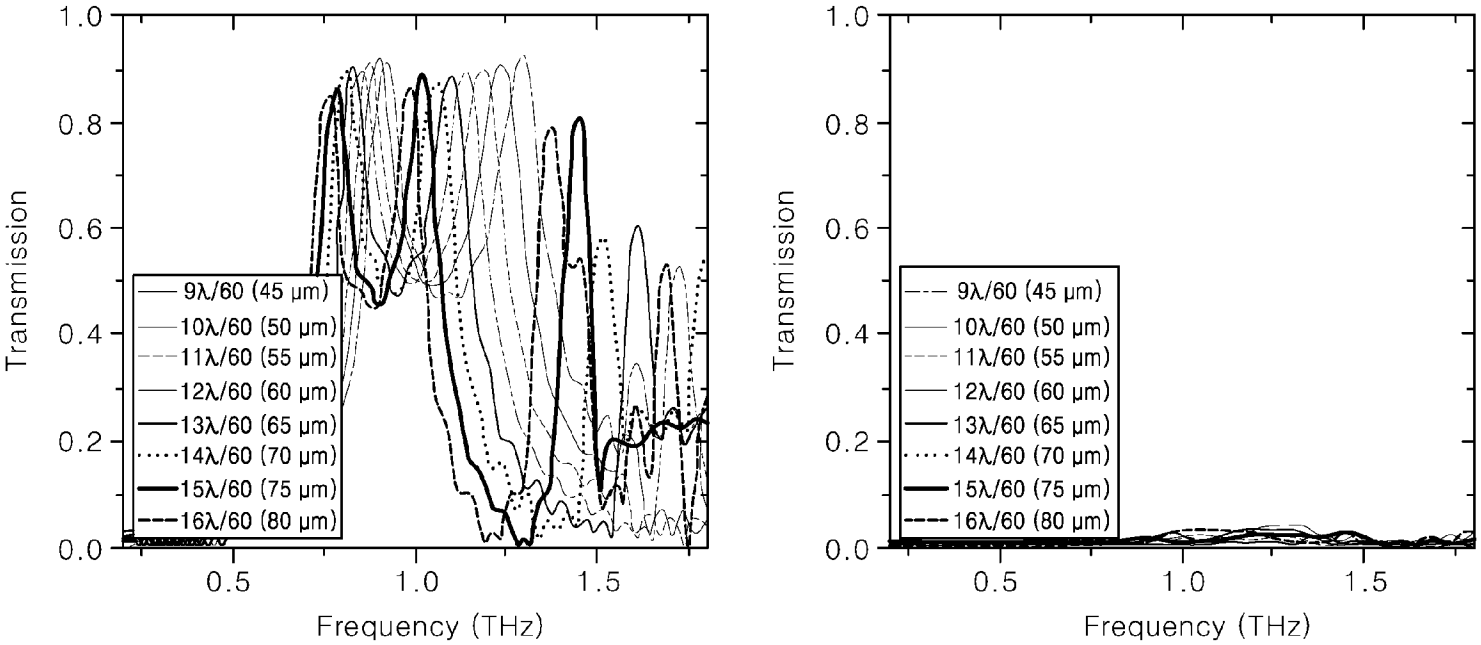

Since the resonance frequency is 1 THz and the wavelength λ of the electromagnetic wave is 300 μm as shown in FIGS. 6 and 7, the conversion efficiency graphs according to the separation distances between the reception antenna 20 and the transmission antenna 30 can be obtained. However, when the resonance frequency and the wavelength length vary, the appropriate separation distance between the reception antenna 20 and the transmission antenna 30 varies. When the separation distance is farther from the proper separation distance, the resonance frequency is shifted to a low frequency band. When the separation distance is closer to the proper separation distance, a noticeable frequency shift does not occur, but the polarization conversion efficiency is lowered due to the evanescent coupling of the reception antenna and the transmission antenna.

Therefore, the appropriate separation distance between the reception antenna 20 and the transmission antenna 30 can be expressed as $2L_{slot}^2/\lambda$ to $2L_{slot}^2/\lambda$ in which $L_{slot}$ is $\lambda/[2(\varepsilon_{sub})^2]$.

In addition, a filler material 50 is filled between the reception antenna 20 and the transmission antenna 30.

The filler material 50 is preferably a material having a low dielectric constant.

Figure 8:
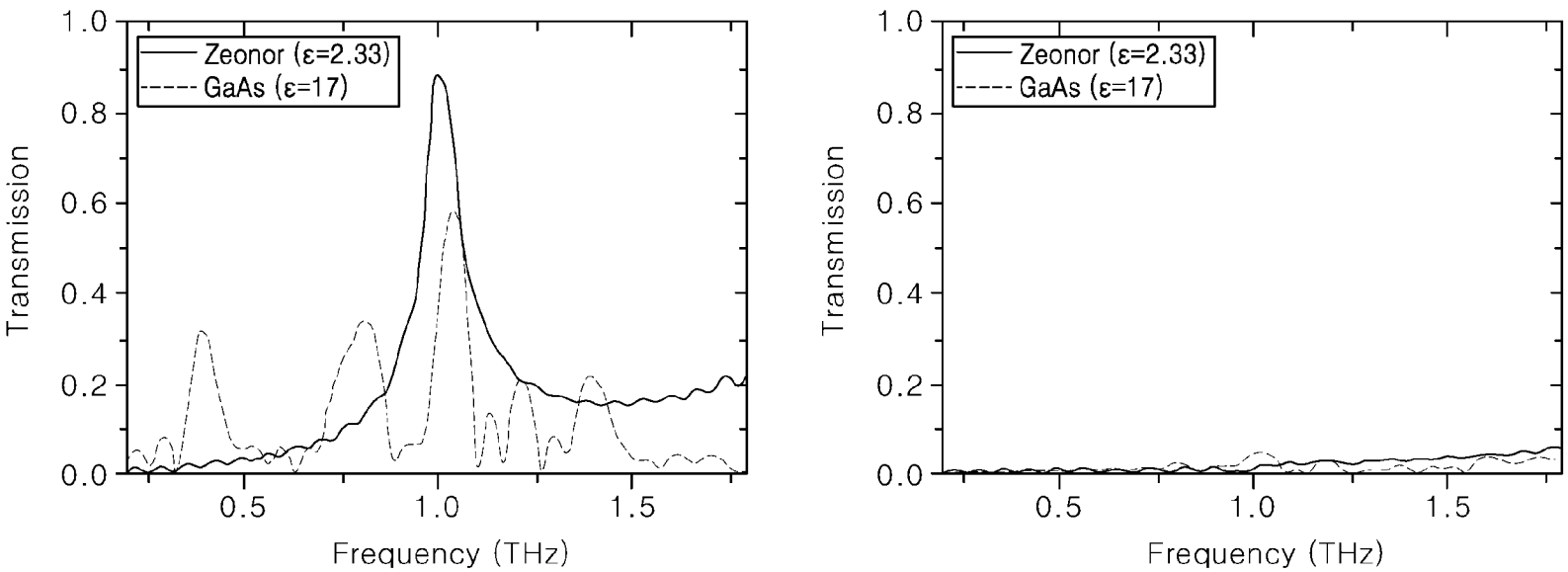
FIG. 8 is a graph showing a conversion result according to a separation distance between a reception antenna and a transmission antenna in a metamaterial-based electromagnetic wave polarization converter according to an embodiment of the present invention.

FIG. 8 shows experimental data for measuring the conversion efficiency of the electromagnetic wave according to the type of the filler material 50.

In the graph, the first curve (e.g. solid line) indicates the experimental value in the case of Zeonor which is a cycloolefin polymer as the filler material 50, and the second curve (e.g. dotted line) indicates the experimental value in the case where gallium arsenide (GaAs) is used as the filler material 50.

Zeonor is a material with a dielectric constant of 2.33 and gallium arsenide has a dielectric constant of 17.

As shown in the graph, it can be seen that the lower the dielectric constant, the better the conversion efficiency. It can be confirmed that Zeonor, a cycloolefin polymer having the lowest dielectric constant in the terahertz range, is the most preferable filler material 50.

Figure 9:
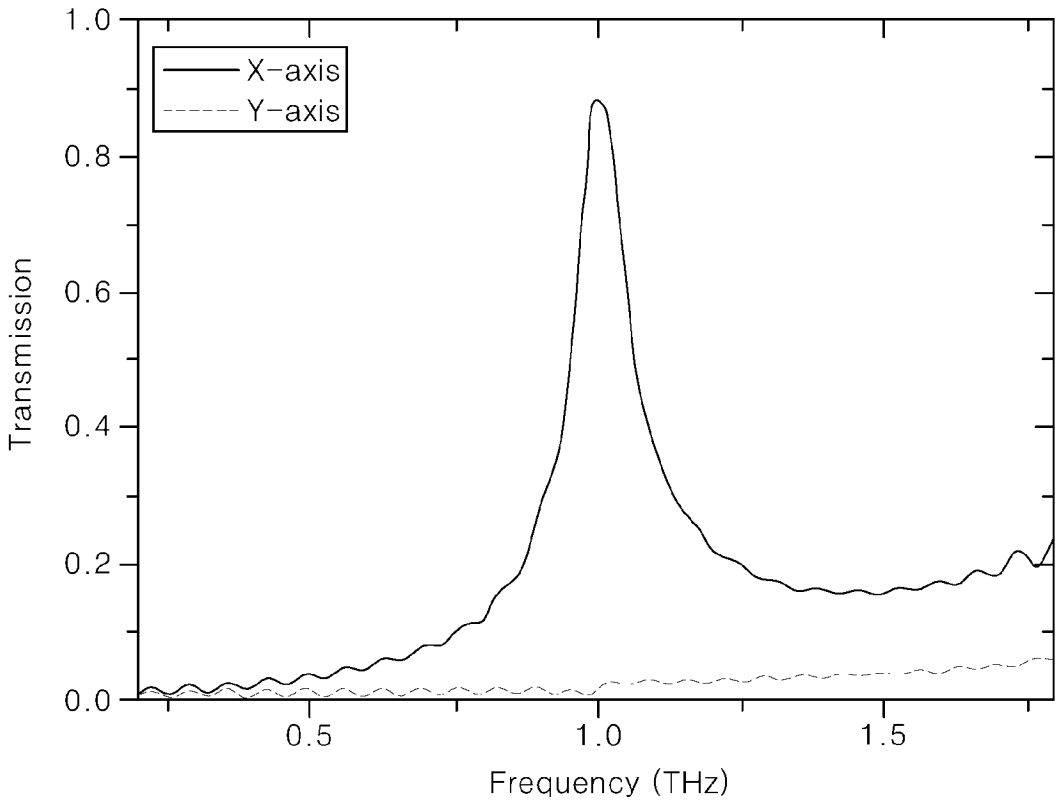
FIG. 9 is a graph showing simulation results of polarization conversion in a metamaterial-based electromagnetic wave polarization converter according to an embodiment of the present invention.

As a result of simulation of the polarization change efficiency of the electromagnetic wave by using the metamaterial-based electromagnetic wave polarization converter 10 according to the embodiments of the present invention, the graph shown in FIG. 9 was obtained.

From the simulation results, it can be seen that an E-field incident in the Y-axis direction is polarized in the X-axis direction after transmission. In this simulation, the resonance point was designed at 1 THz, and the transmittances in the X-axis and Y-axis directions are 0.88 and 0.01, respectively.

Figure 10:
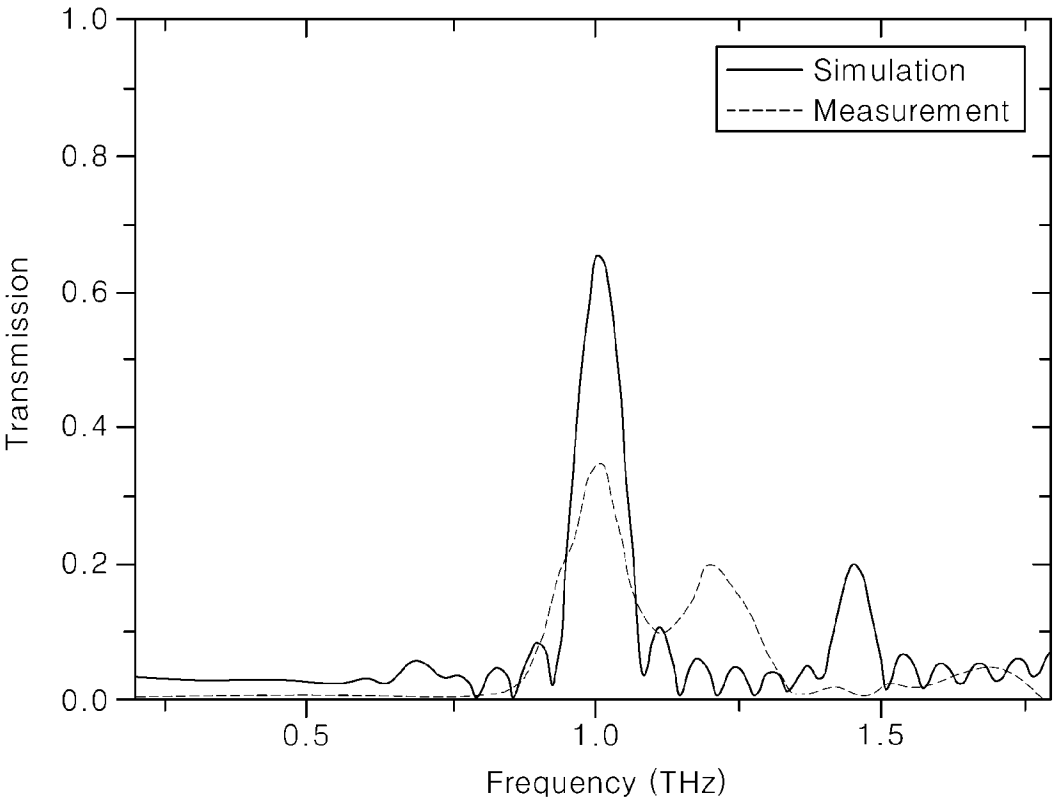
FIG. 10 is a graph for comparison of simulation results and actual measurement values of polarization conversion in a metamaterial-based electromagnetic wave polarization converter according to an embodiment of the present invention.

FIG. 10 is a graph for comparison of simulation results and actual measurement values of polarization conversion in a metamaterial-based electromagnetic wave polarization converter 10 according to an embodiment of the present invention.

The actual experiment proceeded with an instrument TPS-3000. Since the instrument TPS-3000 emits the E-field in the Y-axis direction and measures the E-field in the Y-axis direction, measurements were executed by using two polarization converters.

The transmittances of the simulation value and the measured value were 0.66 and 0.31, respectively, at 1 THz or so. The insertion loss of the polarization converter was multiplied by two. In one polarization converter, the transmittances of the simulation value and the measured value were expected as 0.81 and 0.56, respectively.

As a result of executing the polarization conversion experiment using the actual prototype of the metamaterial-based electromagnetic wave polarization converter, it is not the same as the simulation, but the polarization conversion efficiency of the electromagnetic wave is high in the 1 THz band as in the simulation.

The metamaterial-based electromagnetic wave polarization converter according to the present invention can emit an electromagnetic wave in an angle-converted polarization direction by using a metamaterial, and has an advantage of high conversion efficiency.

The description of the disclosed embodiments is provided to enable any person skilled in the art to make or use the invention. Various modifications to these embodiments will be readily apparent to those skilled in the art, and the generic principles defined herein may be applied to other embodiments without departing from the scope of the invention. Thus, the present invention is not intended to be limited to the embodiments shown herein but is to be accorded the widest scope consistent with the principles and novel features presented herein.

What is claimed is:

1. A metamaterial-based electromagnetic wave polarization converter comprising:

a first part of an antenna made of a first metamaterial and allowing incident electromagnetic waves to resonate at a surface of the first part of the antenna to generate a surface current, wherein the first part of the antenna comprises a first panel member in a plane shape, and the first panel member has a first slot formed thereon and extending in a first direction;

a second part of the antenna made of a second metamaterial at a rear side of the first part of the antenna, wherein the second part of the antenna comprises a second panel member in a plane shape, and the second panel member has a second slot formed thereon and extending in a second direction, and;

at least one tubular connector made of a conductive material that connects the first part and the second part of the antenna, to thereby transfer a surface current generated from the first part of the antenna to the second part of the antenna, wherein the metamaterials of the first part and the second part of the antenna are made of a conductive material and has a shape of a periodic pattern with a size smaller than a wavelength of an incident electromagnetic wave and a negative permeability, and the second metamaterial in the second part of the antenna allows the electromagnetic waves transferred from the first part of the antenna to resonate to then be emitted in a polarization direction, and wherein the first direction of the first slot and the second direction of the second slot are substantially orthogonal with each other corresponding to a conversion angle of an electromagnetic wave to be converted.

2. The metamaterial-based electromagnetic wave polarization converter according to claim 1, wherein the connector comprises a surface layer made of gold, and holes respectively corresponding to the connector are formed in the first part and the second part of the antenna, at connecting positions where the connector is connected to the first part and the second part of the antenna.

3. The metamaterial-based electromagnetic wave polarization converter according to claim 1, wherein a filler material is filled between the first part and the second part of the antenna, and the filler material is a cycloolefin polymer.

4. The metamaterial-based electromagnetic wave polarization converter according to claim 1, wherein a separation distance between the first part and the second part of the antenna is in a vicinity area.

5. The metamaterial-based electromagnetic wave polarization converter according to claim 1, wherein a separation distance between the first part and the second part of the antenna is expressed as $2L_{slot}^{1}/\lambda$ to $2L_{slot}^{2}/\lambda$ in which $L_{slot}$ is $\lambda/[2(\varepsilon_{sub})^2]$.

6. The metamaterial-based electromagnetic wave polarization converter according to claim 1, wherein when the resonance frequency of the electromagnetic wave is 1 THz and the wavelength $\lambda$ of the electromagnetic wave is 300 μm, the separation distance between the first part and the second part of the antenna is 5 μm to 80 μm.

7. The metamaterial-based electromagnetic wave polarization converter according to claim 1, wherein the left-right length and the width of each of the first and second slots are determined by equations $$\frac{\lambda}{[2(\varepsilon_{sub})^2]} \text{ and } \frac{\lambda}{[20(\varepsilon_{sub})^2]},$$

respectively, in which $\lambda$ is a wavelength of an incident electromagnetic wave, and $\varepsilon_{sub}$ is a dielectric constant of a filler material located between the first part and the second part of the antenna.

* * * * *